US008670982B2

(12) United States Patent
Ghenania et al.

(10) Patent No.: US 8,670,982 B2
(45) Date of Patent: Mar. 11, 2014

(54) METHOD AND DEVICE FOR CARRYING OUT OPTIMAL CODING BETWEEN TWO LONG-TERM PREDICTION MODELS

(75) Inventors: Mohamed Ghenania, Le Mans (FR); Claude Lamblin, Perros Guirrec (FR)

(73) Assignee: France Telecom, Paris (FR)

( * ) Notice: Subject to any disclaimer, the term of this patent is extended or adjusted under 35 U.S.C. 154(b) by 1181 days.

(21) Appl. No.: 11/795,085

(22) PCT Filed: Jan. 9, 2006

(86) PCT No.: PCT/FR2006/000038
§ 371 (c)(1),
(2), (4) Date: Apr. 18, 2008

(87) PCT Pub. No.: WO2006/075078
PCT Pub. Date: Jul. 20, 2006

(65) Prior Publication Data

US 2008/0306732 A1 Dec. 11, 2008

(30) Foreign Application Priority Data

Jan. 11, 2005 (FR) ..... 05 00272

(51) Int. Cl.
*G10L 19/00* (2013.01)
*G10L 21/00* (2013.01)

(52) U.S. Cl.
USPC ..... 704/219; 704/220; 704/E19.049

(58) Field of Classification Search
USPC ..... 704/219–223
See application file for complete search history.

(56) References Cited

U.S. PATENT DOCUMENTS

| | | | | |
|---|---|---|---|---|
| 6,687,668 | B2 * | 2/2004 | Kim et al. | 704/223 |
| 6,829,579 | B2 * | 12/2004 | Jabri et al. | 704/221 |
| 7,016,831 | B2 * | 3/2006 | Suzuki et al. | 704/203 |
| 7,184,953 | B2 * | 2/2007 | Jabri et al. | 704/221 |
| 7,505,899 | B2 * | 3/2009 | Serizawa | 704/219 |
| 7,519,532 | B2 * | 4/2009 | Rabha | 704/219 |

(Continued)

FOREIGN PATENT DOCUMENTS

| | | | |
|---|---|---|---|
| WO | WO 03/058407 | A | 7/2003 |
| WO | WO 2004008734 | A2 * | 1/2004 |
| WO | WO 2005/066936 | A | 7/2005 |

OTHER PUBLICATIONS

Ghenania et al. "Low-Cost Smart Transcoding Algorithm Between ITU-T G.729 (8 KBIT/S) and 3GPP NB-AMR (12.2 KBIT/S)" 2004.*

(Continued)

*Primary Examiner* — Greg Borsetti
(74) *Attorney, Agent, or Firm* — Knobbe Martens Olson & Bear LLP

(57) ABSTRACT

Disclosed is a system and method for implementing compression coding of audio signals, such as speech signals, using two long-term prediction (LTP) models. The method determines the parameters of a second long-term prediction model on the basis of the parameters of at least one first LTP model. The present invention is aimed at switching from an LTP model with a single coefficient (monotap) to an LTP model with several coefficients, (multitap) and vice versa, as well as at switching between two multitap LTP models. The complexity of the method may be adjusted, especially as a function of a desired compromise between a target complexity and a desired quality. A device for implementing the method according to the invention is, moreover, very useful for multiple codings in cascade (transcodings) or in parallel (multicodings and multi-mode codings).

26 Claims, 5 Drawing Sheets

(56) References Cited

U.S. PATENT DOCUMENTS

| | | | | |
|---|---|---|---|---|
| 7,792,670 | B2 * | 9/2010 | Jasiuk et al. | 704/219 |
| 2002/0077812 | A1 * | 6/2002 | Suzuki et al. | 704/230 |
| 2003/0033142 | A1 * | 2/2003 | Murashima | 704/219 |
| 2003/0142699 | A1 * | 7/2003 | Suzuki et al. | 370/535 |
| 2003/0177004 | A1 * | 9/2003 | Jabri et al. | 704/219 |
| 2004/0068407 | A1 * | 4/2004 | Serizawa | 704/262 |
| 2005/0137863 | A1 * | 6/2005 | Jasiuk et al. | 704/222 |
| 2005/0154584 | A1 * | 7/2005 | Jelinek et al. | 704/219 |
| 2006/0074644 | A1 * | 4/2006 | Suzuki et al. | 704/223 |
| 2007/0124138 | A1 * | 5/2007 | Lamblin et al. | 704/212 |

OTHER PUBLICATIONS

Kang et al. "Improving the Transcoding Capability of Speech Coders" 2003.*

Lee et al. "A Novel Transcoding Algorithm for AMR and EVRC Speech Codecs Via Direct Parameter Transformation" 2003.*

Kang et al. "Improving Transcoding Capability of Speech Coders in Clean and Frame Erasured Channel Environments" 2000.*

Pankaj. "A Novel Transcoding Scheme from EVRC to G.729AB" 2003.*

Yoon et al. "Transcoding Algorithm for G.723.1 and AMR Speech Coders: for Interoperability between VoIP and Mobile Networks" 2003.*

Tsai et al. "GSM to G.729 Speech Transcoder" 2001.*

Seo et al. "A Novel Transcoding Algorithm for SMV and G.723.1 Speech Coders via Direct Parameter Transformation" 2003.*

Kim et al. "An Efficient Transcoding Algorithm for G.723.1 and EVRC Speech Coders" 2001.*

Yoon et al. "An efficient transcoding algorithm for G.723.1 and G.729A speech coders: interoperability between mobile and IP network" 2003.*

Choi et al. "Improvement Issues on Transcoding Algorithms : For the Flexible Usage to the Various Pairs of Speech Codec" 2004.*

Ghenania M. et al.; "Transcodage Intelligent a Faible Complexite Extre Les Codeurs UIT-T G. 729 et 3GPP NB-AMR (12.2 KBIT/S)" Coresa. Compression et Representation Des Signaus Audiovisuels, 25 mai 2004 (May 25, 2004), pp. 85-88, XP001199662.

Jin-Kyu Choi et al.; "Improvement issues on transcoding algorithms: for the flexible usage to the various pairs of speech codec"; 2004 IEEE International Conference on Acoustics, Speech, and Signal Processign, vol. 1, 17 mai 2004 (May 17, 2004), -21 mai 2004 (May 21, 2004) pp. 269-272, XP002345813; Montreal, Que., Canada ISBN: 0-7803-8484-9 abrege.

* cited by examiner

FIG. 5a
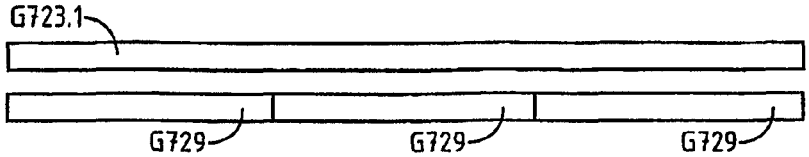
FIG. 5b
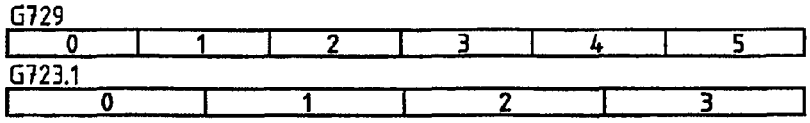
FIG. 6
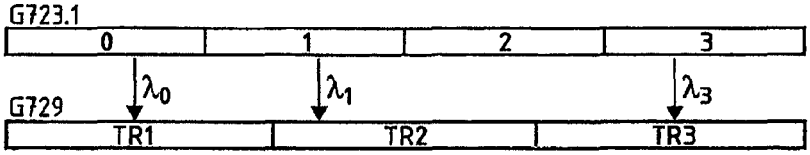
FIG. 7a
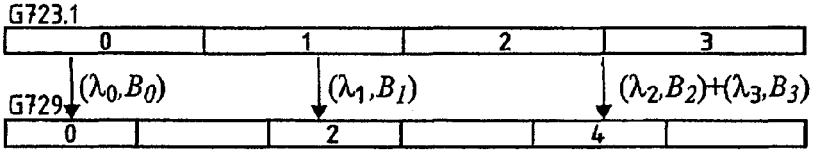
FIG. 7b
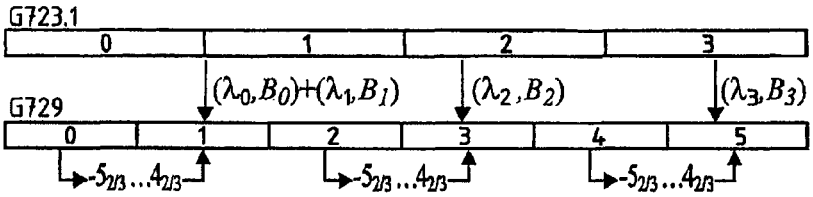
CG → | G729 | G723.1 | ← CD
| G729 | G723.1 |
|---|---|
| 0 | 0 |
| 1 | 0.1 |
| 2 | 1 |
| 3 | 2 |
| 4 | 2.3 |
| 5 | 3 |
FIG. 8

METHOD AND DEVICE FOR CARRYING OUT OPTIMAL CODING BETWEEN TWO LONG-TERM PREDICTION MODELS

This application claims priority from PCT/FR2006/000038 filed Jan. 9, 2006, which claims priority from French Application FR 05 00272, filed Jan. 11, 2005, both of which are hereby incorporated by reference in their entirety.

FIELD OF DISCLOSURE

The present invention relates to the compression coding/decoding of digital audio signals, in particular of speech signals and/or of multimedia signals, in particular for transmission or storage applications. It is more especially aimed at effective determination of the parameters of a second long-term prediction model (or "LTP" for "Long Term Prediction"), on the basis of the parameters of at least one first LTP prediction model.

BACKGROUND

Compression coders use properties of the digital audio signal such as its local stationarity, utilized by short-term prediction filters, as well as its harmonic structure, utilized by LTP long-term prediction filters. Typically, the voiced sounds of a speech signal (such as the vowels) exhibit a long-term correlation due to the vibration of the vocal cords. The long-term correlation is modeled by an LTP filter denoted P(z) which makes it possible to retrieve the harmonic structure by using a synthesis filter of the type:

$$H_{LT}(z) = \frac{1}{1 - P(z)}$$

The simplest form of the long-term prediction filter is the filter P(z) with a single coefficient β (also called the gain) and integer delay T such that $P(Z)=\beta Z^{-T}$. The delay T is also called the "pitch" period, or more simply the "pitch".

Currently, more elaborate modelings are aimed at:

modeling with several coefficients (termed "multitap"):

$$P(z) = \sum_{i=-k}^{k} \beta_i z^{-T-i},$$

or else modeling with multiple delays:

$$P(z) = \sum_{i=-1}^{k} \beta_i z^{-iT};$$

or else modeling with a fractional delay which uses over- and under-samplings with interpolation filters:

$$P(z) = \beta \sum_{i=0}^{2l-1} p_l(i) z^{-(T-l+i)},$$

where for a delay (T+1/D), of resolution 1/D, the coefficients $p_1(i)$ are given by $p_1(i)$=hinter (iD−1), 0≤1≤D−1, hinter being an interpolation filter of length 2ID+1.

The parameters of the filter (delay and gain(s)) vary according to the signals to be coded and for one and the same signal over time. For example, in speech coding, the span of the pitch periods seeks to cover the range of the fundamental frequencies of the human voice (from low voices to high voices). For one and the same talker, this frequency also varies temporally. Likewise, the coefficient(s) of the filter also evolves(evolve) over time.

On coding, the parameters of P(z) are determined either by an open-loop analysis or by a closed-loop analysis or usually by a combination of both analyses. The open-loop analysis is performed by minimizing the prediction error in the signal to be modeled. The closed-loop analysis (termed "analysis by synthesis") minimizes the quadratic error, usually weighted, between the voice signal to be modeled and the synthesis signal. Usually, an open-loop search is firstly envisaged so as to determine a first estimate of the pitch called the "open-loop pitch". Then, a search based on analysis by synthesis over a restricted neighborhood around this anchoring value makes it possible to obtain a more accurate value of the pitch. These analyses are performed on blocks of samples. The lengths of the open-loop and closed-loop analysis blocks are not necessarily equal. Often, a single open-loop analysis is performed for several closed-loop analyses.

For any LTP model (monotap or multitap), the determination of the LTP parameters is very expensive in terms of calculational complexity. It generally consists of an open loop over a large block of samples followed by closed loops over several sub-blocks of samples (also called subframes). In particular, the open-loop search for the harmonic lag is a very expensive operation, on coding. Usually, it requires the calculation of an auto-correlation function of the signal for numerous values (in fact over a span of variation of the delays). In the coder according to the UIT-T G.723.1 standard, this span of delays comprises 125 integer delays (from 18 to 142) and the open-loop delay is estimated every 15 ms (i.e. therefore for blocks of 120 samples). In the coder according to the 8-kbits/s UIT-T G.729 standard, the open-loop analysis is performed every 10 ms (at each block of 80 samples) and explores a span of 124 integer delays (from 20 to 143). This operation constitutes nearly 70% of the complexity of the LTP analysis for this type of coding.

Even though it is focused around the delay obtained in open loop, the closed loop is also extremely expensive in terms of calculations and, consequently, resources. It requires the generation of adaptive excitations and their filtering. For example, in the G.723.1 coding which uses a multitap LTP model, the closed-loop analysis jointly determines the vector of gains (βi) and a lag λ (in the guise of candidate pitch) of each subframe by exploring a dictionary of gain vectors for several candidate pitch values. This analysis constitutes nearly half the total complexity of the 5.3-kbits/s G.723.1 coder.

The complexity of the LTP analysis is especially critical when several codings must be performed by one and the same processing unit such as a gateway responsible for managing numerous communications in parallel or a server distributing numerous multimedia contents. The problem of complexity is further increased by the multiplicity of compression formats which circulate around the networks. Several codings are then envisaged, either in cascade (or "transcoding"), or in parallel (multi-format coding or multi-mode coding). Transcoding is typically used when, in a transmission chain, a compressed signal frame sent by a coder can no longer continue its path, in this format. Transcoding makes it possible to convert this frame into another format compatible with the rest of the transmission chain. The most elementary solution (and the commonest at present) is to abut a decoder and a coder. The compressed frame, arriving in a first format, is decompressed. This decompressed signal is then re-compressed into a second format accepted by the rest of the communication chain. This cascading of a decoder and a coder is called "tandem". Nevertheless, this solution is very expensive in terms of complexity (essentially because of the recoding) and degrades the quality, the second coding being done in fact on a decoded signal which is a degraded version of the original signal. Additionally, a frame may encounter several tandems before arriving at its destination, thereby further increasing the cost in terms of calculation and the loss of quality. Furthermore, the delays related to each tandem operation accumulate and may be detrimental to the interactivity of the communications.

As regards the multi-format compression systems where one and the same content is compressed in several formats (typically in the case of content servers which broadcast one and the same content in several formats suited to the conditions of access, networks and terminals of the various end users), the multi-coding operation becomes extremely complex as the number of desired formats increases, and this may rapidly saturate the resources of the systems. Another case of multiple coding in parallel is multi-mode compression with a posteriori decision according to which, at each signal segment to be coded, several compression modes are executed and the mode which optimizes a given criterion or obtains the best throughput/distortion compromise is selected. Here again, the complexity of each of the compression modes limits their number and/or leads to a very restricted number of modes being selected a priori.

Currently, most multiple coding operations do not yet take full account of the similarities between coding formats, and this could however reduce the complexity and the algorithmic delay while limiting the degradation introduced. For one and the same coding format parameter, the differences between coders reside in the modeling, the procedure and/or the frequency of calculation, or else the quantization.

Generally, the solutions proposed today endeavor to limit the number of values explored for the parameters of a second LTP model by using the parameters chosen by the first format, to reduce the complexity of the LTP search for the second format.

Transcoding between two monotap LTP models is the simplest case. Most of the currently proposed procedures relate to transcoding between delays, the transcoding of the LTP gain usually being performed at the actual signal level (one speaks of "partial" tandem) when the two models are identical (the same dictionary of delays and same subframe length), a simple copy of the binary fields of the delays from one bit stream to the other is sufficient. When the dictionaries differ by their resolution (integer or fractional ⅓, ⅙, etc.) and/or by their spans of values, a transcoding into the binary or parameter domain, with a possible transformation, is used. The transformation may be a quantization, a truncation, a doubling or a splitting. When the lengths of the subframes of the two formats are different, an interpolation of the delays may be provided. For example, the delays of a first format overlapping an output subframe are interpolated. It is then possible to use this interpolated delay only when the latter is close to the delay obtained at the previous subframe, otherwise a conventional search is conducted. Another more direct procedure, without interpolation, consists in selecting a delay from among these delays of the first format. This selection may be made according to several criteria: last subframe, subframe having the most samples in common with the subframe of the second format or else that which maximizes a criterion which depends on the LTP gain. The delay determined is an anchoring value for the search for the delay of the second format. It may be used as open-loop delay of the second format around which a conventional or restricted closed-loop search is performed, or as a first estimate of it, or as anchoring of a delay trajectory.

In the case of a transcoding between a monotap LTP modeling and a multitap LTP modeling, the only implementation that is provided for at present is simply in the signal domain, owing to the dissimilarity of the modelings. Most of the existing transcoding techniques limit themselves to reducing the complexity of the open loop of the second format by selecting one of the delays of the first format or an interpolation of these delays as open-loop delay. However, a few techniques have been proposed for also reducing the complexity of the closed loop.

In document WO-03058407, the fractional delay $\lambda'$ of a monotype model is determined on the basis of the vector of coefficients ($\beta_i$) of a multitap model by calculating the expression:

$$\lambda' = \lambda - \frac{\sum_{j=-2}^{2} j\beta_j^2}{\sum_{j=-2}^{2} \beta_j^2}$$

In document reference [1]:

"An Efficient Transcoding Algorithm for G.723.1 and G.729A Speech Coders", Sung-Wan Yoon, Sung-Kyo Jung, Young-Cheol Park, and Dae-Hee Youn, Proc. Eurospeech 2001, pp. 2499-2502, the closed-loop search for the vector of gains of a multitap model is restricted to a subset of the dictionary of multitap gains, which is determined by the gain of the monotap model of the first format. This determination, as well as the composition of the subsets are performed as follows: the global gain of each vector of the dictionary of gains is calculated; next, on the basis of 170 global gains corresponding to the 170 vectors of the dictionary, 8 subsets are constructed and a single one of these subsets is selected depending on the LTP gain of the first monotap model.

In a variant according to the document referenced [2]:

"Transcoding algorithm for G723.1 and AMR Speech Coders: for Interoperability between VoIP and Mobile Networks", Sung-Wan Yoon and al., Proc. Eurospeech 2003, pp. 1101-1104, the subsets are built up by learning as follows: the span of variation of the monotap gain of an NB-AMR coder is divided into 8 subsections, then, for each subsection, a statistical study on an NB-AMR tandem makes it possible to determine M vectors of gains of the dictionaries of a coder according to the G.723.1 standard. These gain vectors are statistically the most probable. The number M is taken equal to 40 for the dictionary comprising 85 vectors and to 85 for the dictionary comprising 170 vectors. During the search for the optimal vector of gains, the exploration of the dictionary is limited to the subset associated with the subsection to which the gain of the NB-AMR coder belongs.

To the knowledge of the inventors, there is at present no technique for transcoding between two multitap LTP modelings. As was seen above, most of the current solutions relate only to monotap LTP models. Certain techniques propose a transcoding between a multitap model and a monotap model but limit themselves to reducing the complexity of the search for the open-loop delay of the second format.

Among the few approaches proposed for reducing the complexity of the closed loop, some are based on approximating a multitap LTP filter by a monotap LTP filter (fractional or otherwise). For example, in the case of an approximation of a multitap filter:

$$P_{multi}(z) = \sum_{i=-k}^{k} \beta_i z^{-T-i}$$

by a nonfractional monotap filter $P_{mono}(z)=\beta z^{-(T-\delta)}$, a gain $\beta$ and a delay jitter $\delta$ are estimated such that: $P_{mono}(z)\approx P_{multi}(z)$, for all the integer delays T considered.

The approximating of a multitap LTP model by a monotap LTP model has already been utilized from the UIT-T G.723.1 standard, in fact to estimate the adaptive prefilter and also to control the instability of the LTP filter. The studies conducted during the design of the coder according to the G.723.1 standard have shown that it is not always possible to satisfactorily approximate a multitap LTP filter by a monotap LTP filter, over a wide span of delays, with the same gain $\beta$ and the same jitter $\delta$ in the delay. For one and the same vector of gains ($\beta_i$), the estimate of the optimal pair ($\beta$, $\delta$) may vary greatly as a function of the delay T. In the coder according to the G.723.1, it has been possible to overcome this difficulty since the stability control procedure picks out the maximum gain from among the estimated gains (which may then be very dissimilar) and the adaptive prefilter is disabled for any vector of gains of the multitap model when, over the relevant span of delays, the estimated gains are too different or the jitters in the delay are too dissimilar or too large. If, for the modules for adaptive pre-filtering and instability control of the long-term prediction filter, it is possible, to overcome the difficulty of estimation without degrading performance, these advantages are more difficult to achieve with the LTP analysis module itself which plays a crucial role with regard to quality. Thus, according to the vector of gains and/or the delay considered, the 170 global gains calculated for each vector of the 170 entries of the dictionary, as seen in the prior art above [1], may be very far from the optimal gains. Likewise, according to the vector of gains ($\beta_i$) and/or the delay $\lambda$, the calculation of the fractional delay $\lambda'$, as seen in the prior art WO-03058407 hereinabove, may lead to a poor determination of the fractional delay.

Whether the approach be analytical or statistical, the approximating, over a wide range of delays, of a multitap LTP filter by a single monotap LTP filter (or the inverse approximation) is too inaccurate. To solve this problem, it would, in order to take account of the variation of the gain $\beta$ and/or of the jitter $\delta$ according to the delay T, be possible to store a pair ($\beta$,$\delta$) for each delay T. However, this solution would be too expensive in terms of storage since it would require the storage of a pair for each gain vector and for each delay of the span. In the case of the approximation of the multitap LTP filters of the G.723.1 code, which comprises two multitap dictionaries of 170 and 85 vectors, with a span of 125 delays, it would be necessary to store 31875 (=125*(170+85)) pairs. Moreover, this solution would not solve the cases where the approximation of a multitap by a monotap is really too inaccurate, or even erroneous. It will be noted that conversely, several pairs ($\beta$,$\delta$) may also constitute good approximations of a multitap LTP filter.

The present invention intends to improve the situation.

SUMMARY

Firstly, the present invention is aimed at switching from an LTP model with a single coefficient (monotap) to an LTP model with several coefficients, (multitap) and vice versa, as well as at switching between two multitap LTP models. In particular, it proposes a method whose complexity may be adjusted, especially as a function of a desired compromise between a target complexity and a desired quality. A device for implementing the method according to the invention is, moreover, very useful for multiple codings in cascade (transcodings) or in parallel (multi-codings and multi-mode codings).

Thus, the invention is firstly aimed at a method of coding according to a second format, on the basis of information obtained by implementing at least one step of coding according to a first format. The first and second formats implementing, in particular for the coding of a speech signal, a step of searching for LTP long-term prediction parameters by exploring at least one dictionary comprising candidate parameters, one at least of the first and second coding formats using a filtering with several coefficients (so-called "multitap" hereinabove) for a fine search for the LTP parameters.

According to a general definition of the invention, the method comprises the following steps:

a) defining orders of at least one dictionary that the second coding format uses, b) recovering an a priori information, obtained following the determination of the LTP parameters in the course of the coding according to the first format, so as to select at least one order of said dictionary, c) applying the selected order to the candidates of said dictionary so as to choose a limited number of first candidates, and d) so as to perform the second coding, conducting the LTP search only among said limited number of candidates.

The invention therefore differs from the existing solutions through the definition of orders in the dictionary and the utilization of these orders in the dictionary exploration procedure.

BRIEF DESCRIPTION OF THE DRAWINGS

Other features and advantages of the invention will become apparent on examining the detailed description hereinbelow, and the appended drawings in which:

FIG. 5*a* illustrates a correspondence between the frames of a coder according to the UIT-T G.723.1 standard (30 ms) and the frames of a coder according to the UIT-T G.729 (10 ms) standard, FIG. 5*b* illustrate a correspondence between the subframes of the G.729 coder (5 ms) and the subframes of the G.723.1 coder (7.5 ms), FIG. 6 illustrates open-loop pitch search of the G.729 on the basis of the pitch values of the G.723.1, —FIGS. 7*a* and 7*b* respectively illustrate the association between even (respectively odd) subframes of the G.729 coder and the suite of LTP parameters arising from the G.723.1 coder in the guise of coder according to the first format, FIG. 8 represents a table associating the subframes of the G.723.1 (right-hand column CD) with the subframes of the G.729 (left-hand column CG)

DETAILED DESCRIPTION OF EMBODIMENTS

The present invention therefore pertains to multiple coding in cascade or in parallel or to any other system using, to represent the long-term periodicity of a signal, a modeling of monotap or multitap type. The invention makes it possible on the basis of the knowledge of the parameters of a first model to determine the parameters of a second model in the case where at least one of the two models uses a multitap modeling. For the sake of conciseness, only the case of a switch from a first model to a second is described but it will be understood that the invention applies also in the case of switching from m (m≥1) first models to n (n≥2) second models (where m and n are absolutely arbitrary).

Figure 1A:
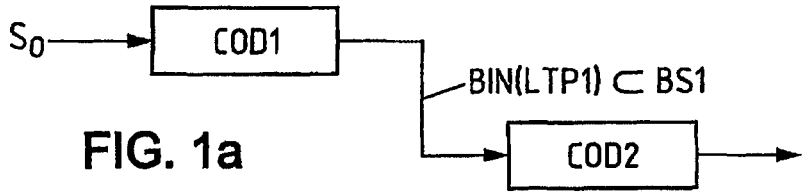
FIG. 1*a* schematically represents an intelligent transcoding system using a device for coding according to the second format within the meaning of the invention, FIG. 1*b* schematically represents a system for multiple coding in parallel, using a device for coding according to the second format within the meaning of the invention.
Figure 1B:
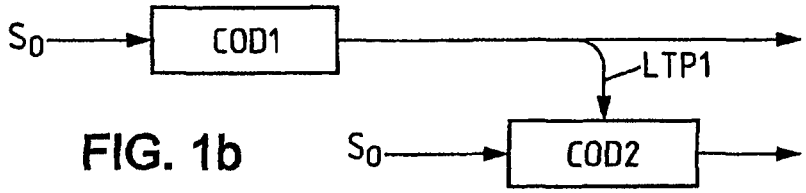

With reference to FIGS. 1*a* and 1*b*, consideration is therefore given to the case of two LTP modelings of a signal corresponding to two coding systems COD1 and COD2. This may involve a switch from the first coding system COD1 to the second coding system COD2, in cascade especially by intelligent transcoding (FIG. 1*a*) or in parallel especially by optimizing the multiple coding (FIG. 1*b*). The first coder has performed its coding operation on a given signal (for example the original signal $s_0$). Hence, LTP parameters, denoted LTP1, chosen by the first coder COD1, are available. This coder has determined these parameters by a technique of its own during the coding process. The second coder COD2 must likewise carry out its coding. In the case of transcoding, only the binary train BS1 generated by the first coder COD1 and thus including the binary codes of the parameters LTP1 is available to the second coder COD2. The invention is therefore applicable here to intelligent transcoding. In the case of multiple parallel coding, the original signal $s_o$ (or a derived version) available to the first coder COD1 is also available to the second coder COD2 and the invention applies here to intelligent multicoding. It is indicated that the invention may also be applied to the particular case of multiple parallel coding, namely multi-mode coding with a posteriori decision.

The present invention pertains to the determination of a parameter of an LTP model, denoted LTP2, from at least one parameter LTP1 of another LTP model, when at least one of the two models is a multitap model. Instead of searching for the parameter of the second coding format in its definition set (or "dictionary"), the invention provides for the following steps, referring now to FIG. 2:

in the dictionary DIC2 of the second coding format (bearing the reference 25 in FIG. 2), orders ORD1, ORD2, . . . , ORDN are initially determined (step 25*b* of FIG. 2), on the basis of at least one of the parameters LTP1 of the first coding format, at least one order ORD(DIC2) of the dictionary of the second format is selected (step 26).

in step 27, an ordered succession of the elements of the dictionary $e_i^2$, $e_j^2$, $e_k^2$, . . . , is obtained, the exploration is advantageously limited to the first elements $e_i^2$, $e_j^2$, of the dictionary DIC2 thus ordered (step 29), the number of elements preferably being chosen according to the quality/complexity compromise desired (target quality/permitted complexity), in step 28.

Figure 2:
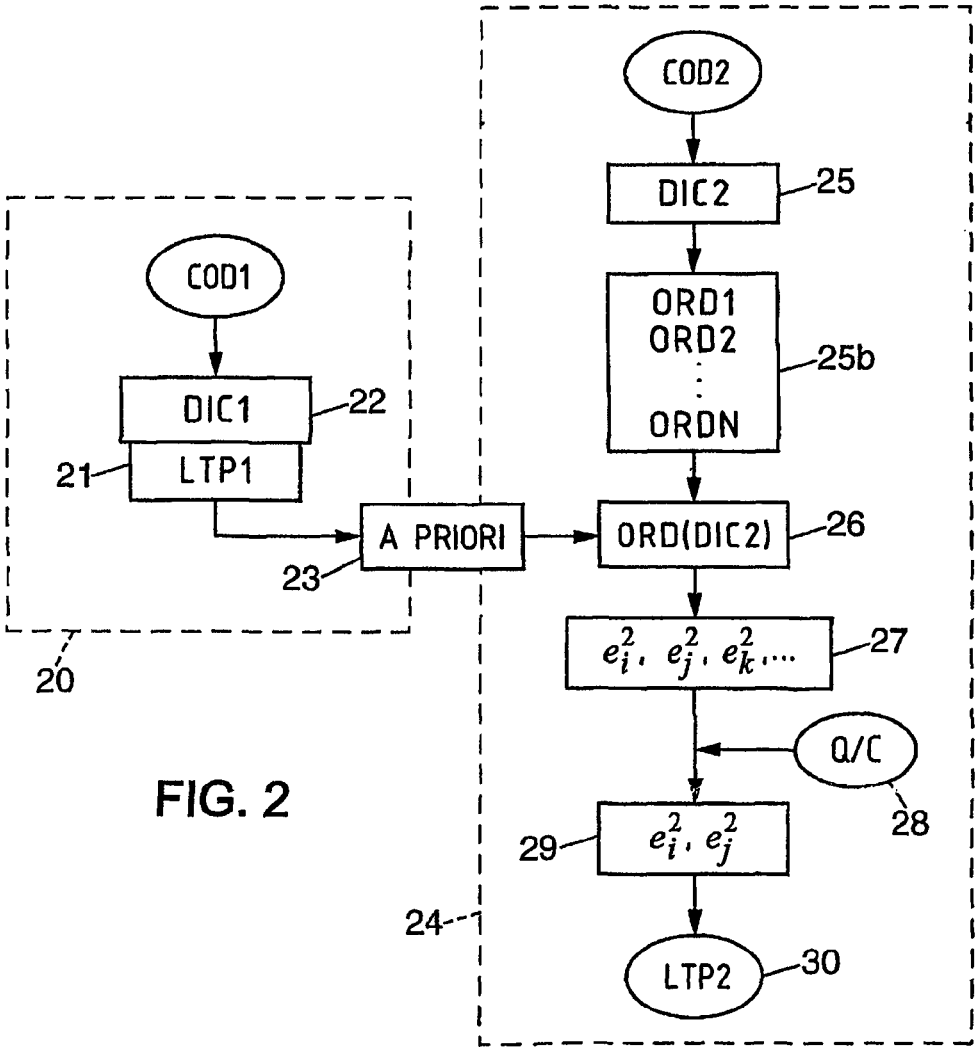
FIG. 2 illustrates the main steps of the method within the meaning of the invention, FIG. 3 schematically represents the means implemented by a coding device within the meaning of the invention, FIG. 4*a* representing a basic diagram of a CELP coder (standing for "code excited linear prediction"), FIG. 4*b* schematically represents the steps of the LTP analysis of a coder according to the UIT-T G.729, FIG. 4*c* schematically represents the steps of the LTP analyser of a coder according to the UIT-T G.723.1 (6.3 kbit/s) standard.

Thus, it will be understood that it is possible to limit, by implementing the invention, the number of elements of the second dictionary DIC2 to which the LTP search will pertain during the second coding COD2, while ensuring good quality of the coding COD2. In FIG. 2, the operations conducted respectively by the first coder COD1 and the second coder COD2 have been separated into two blocks 20 and 24, the dictionary DIC2 (reference 25) being available to the latter coder. On its side, the first coder COD1 has determined the parameters LTP1, in step 21, using at least its dictionary DIC1 (step 22). It will thus be understood that the way in which the first coder COD1 has determined its parameters LTP1, typically on the basis of the original signal $s_o$, constitutes an a priori information (step 23) which can be used by the second coder to order its dictionary DIC2. Finally, the parameters LTP2 obtained (step 30) by applying the classification of the dictionary of the second coder within the meaning of the invention, will themselves be able to serve for the classification of a dictionary according to yet a third coding format (not represented), as appropriate, and so on and so forth for a cascade transcoding or a multiple coding in parallel.

It will be noted that FIG. 2 is given here only for mainly didactic purposes. For example, the notation $e_i^2$, $e_j^2$, $e_k^2$ of the elements of the dictionary DIC2 is not actually conventional, as will be seen later. Additionally, the classification of the dictionary DIC2 (step 25*b*) and the limitation of its elements to be taken into account for the search as a function of the quality/complexity criterion (step 28) may be conducted jointly substantially in one and the same step. Finally, represented in FIG. 2 is a first coder COD1 delivering the a priori information (step 23) to the second coder COD2. Nevertheless, as a variant, the second coder COD2 may simply recover from the first coder COD1 the binary codes of the parameters LTP1 that the first coder has determined and retrieve these a priori information by virtue in particular of the knowledge of the type of coding and of the dictionary used by the first coder COD1.

Figure 3:
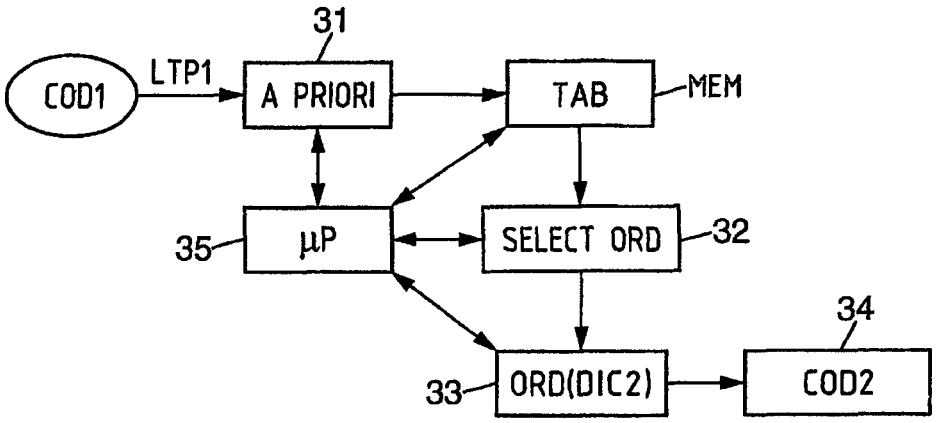

Represented in FIG. 3 is a device for coding according to the second format, within the meaning of the invention. This device is devised so as to use coding information by implementing a coding according to a first format (here the parameters LTP1 recovered from the coding according to the first format COD1). The device within the meaning of the invention comprises, in the example represented:

a memory MEM storing a correspondence table defining, as a function of LTP1 parameters determined by the first coding format, orders of a dictionary that the second coding format uses, means, such as an interface 31, for recovering a signal giving at least one a priori information on LTP1 parameters in the course of a coding according to the first format, means 32 active on reception of said signal for consulting said correspondence table and selecting at least one order of the dictionary of the second format, calculation means, such as a processor 35, for:

ordering the dictionary 33 of the second format according to the selected order, with a view to choosing a limited number of first candidates from the dictionary 33, and continuing the coding according to the second format, with other modules 34 as appropriate, by conducting the LTP search only among this limited number of candidates.

Of course, the processor 35 manages all or some of the modules of the device. For this purpose, it may be driven by a computer program product. The present invention is moreover aimed at such a computer program product, stored in a memory of a processing unit or on a removable medium intended to cooperate with a reader of said processing unit or downloadable from a remote site, and comprising instructions for implementing all or some of the steps of the method according to the invention.

It will be understood in particular that the device COD2, within the meaning of the invention, can directly recover the parameters LTP1 of the first coder COD1 so as to deduce therefrom the aforesaid a priori information and, thereby, the order of its dictionary DIC2, or, as a variant received from the first coder COD1 directly the a priori information regarding the order of its dictionary, of the first coder COD1. In the latter case, the first coder COD1 already plays a particular role in the invention.

The present invention is also aimed at a system which includes the first coder and the device within the meaning of the invention. Specifically, the device of FIG. 3 can be inserted into a coding system implementing at least one first and one second coding format. This system then comprises at least one device for coding according to the first format COD1 and one device for coding within the meaning of the invention and then applying second format COD2. In this regard, the invention is aimed at such a system. The device for coding according to the first format and the device for coding according to the second format may be placed in cascade, for a transcoding, as represented in FIG. 1*a*. As a variant, the device for coding according to the first format and the device for coding according to the second format may be placed in parallel, for a multiple coding, as represented in FIG. 1*b*.

In the implementation of the invention, it will be supposed that the second coder COD2 can recover from the first coder COD1, (when the latter has determined the parameters LTP1) information which will enable it to order its dictionary DIC2 (see FIG. 2). Thereafter, an LTP search among only the first elements ($e_i^2$, $e_j^2$) of the dictionary DIC2 thus ordered will make it possible to preserve good quality for the second coding.

Advantageously, the utilization of the orders of the second dictionary DIC2 offers great flexibility regarding the number of ordered elements to be explored. It is then possible:

to freely adjust the quality/complexity compromise, of else, for a given complexity, optimize the quality, or conversely, minimize the complexity for a given quality.

This adjustment may be performed at the start of the processing. It may also be performed at each block to be processed as a function of parameters of the first coding format and/or of the characteristics of the signal to be coded (for example, as a function of a voicing criterion). For one and the same block, the complexity may also vary as a function of the LTP subframes. The invention offers great flexibility which makes it possible to dynamically distribute the calculational power available between the modules of the second coder and/or the resources to process the LTP subframes.

Preferably, it is on the basis of an initial partition of the dictionary DIC1 associated with a parameter of the first LTP model that orders of the dictionary DIC2 associated with a parameter of the second LTP model are determined. It is indicated that the determination of an order consists in ranking the elements of the second dictionary DIC2 according to a certain criterion. A ranking (or "order") is given by an indexation of the elements of the dictionary DIC2.

Several types of partition of the first dictionary DIC1 may be envisaged. A first example is the elementary partition of a dictionary DIC1 of N elements into N disjoint classes of size 1. N orders of the second dictionary are then determined. More elaborate partitions may be chosen, in particular by techniques known per se of (vector or scalar) quantization or of data classification.

Advantageously, it is possible to group similar orders together, this amounting to modifying the initial partition of the first dictionary and, consequently, the number of orders of the second dictionary. It is also possible to recalculate the orders once they have been grouped together. The procedures for determining the partition of the first dictionary into N classes and for calculating the N orders of the second dictionary may be iterated, it being possible moreover for the number N to vary in the course of the iterations. As a variant or as a supplement, to limit the memory required for storing the orders of the second dictionary, for each of these orders, a maximum number of elements to be retained is chosen, this number possibly differing according to the orders and/or the classes of the first dictionary.

In a further variant, the classes of the first dictionary are not necessarily disjoint. Typically, one and the same element may be associated with more than one order of the second dictionary. The choice of the order or the combination of orders may then take account of factors other than the current LTP parameter of the first dictionary.

Initially, the number of orders and the orders which are appropriate in the second dictionary are determined by a statistical and/or analytical study, as a function of successive suites of LTP parameters according to the first model. This study therefore defines, for each class of the partition of the dictionary associated with an LTP parameter of the first format, a ranking of the dictionary of a parameter of the second format. A statistical study has been carried out on an off-line bank by associating in one and the same coder the LTP model of the first format and the LTP model of the second format. The placing of the two LTP analyses in parallel has been the preferred learning configuration. Of course, other configurations may be used, in particular a conventional tandem which cascades the two codings. The statistical study ensures, for each element of the first dictionary (or each class of its partition), a ranking of the elements of the second dictionary according to a certain criterion. Preferably, this criterion evaluates the impact on the quality of the signal retrieved. Specifically, the quality criterion can be that used on coding to select the second LTP parameter. Of course, other criteria may be used, in particular the invoking of an element of the second dictionary for a class of the first dictionary. Furthermore, a combination of criteria may also be used.

An analytical study may also be performed to determine orders of the second dictionary as a function of a partition of the first dictionary. Preferably, the analytical study completes the statistical study described above. It is preferably limited to the dictionary parts which lead to satisfactory analytical approximations.

The determination of an LTP parameter of the second coding format, on the basis of the LTP parameters according to the first coding format, will now be described.

Within the framework of the design of algorithms for restricted exploration of the second dictionary knowing the LTP parameters chosen by the first coding format, preferential utilization is made of the partition of a first dictionary and the orders of the second dictionary which are associated with this partition of the first dictionary.

For the sake of the clarity of the account, the principals of the algorithm used are first described when the two coding formats have LTP subframes of identical duration. To each current subframe of the second coding format there corresponds a single subframe of the first coding format. For this first subframe, the first coding format has selected a suite of LTP parameters (termed the "first suite LTP1"). By virtue of the partition of the dictionary associated with one of the LTP parameters of the first model, an order of exploration of the second dictionary is selected by choosing the order associated with the class of the element of the first suite LTP1. Next, the second dictionary is explored in accordance with the order thus determined. Moreover, as a function of a quality/complexity compromise and/or possibly of the maximum number of elements of the second dictionary retained for the class, the number of elements tested is restricted. In general, it will therefore be supposed that, among all the elements of the second dictionary, only the first elements determined by the order which has been chosen are tested.

When the two coding formats have LTP subframes of different durations, it transpires that a current subframe of the second format may correspond to more than 1 subframe of the first format. This situation is illustrated in FIG. 5*b*, by way of example. For these first subframes, the first coding format has selected suites of LTP parameters. By virtue of the partition of the dictionary associated with one of the LTP parameters of the first model, orders of exploration of the second dictionary are preselected by choosing the orders associated with the classes of the elements of the first suites. It may happen that a single order is finally selected if the parameters chosen for the first subframes belong to the same class of the partition of the first dictionary. However, this is a particular case. This brings us back to the previous scheme corresponding to LTP subframes of identical duration. If, conversely, more than one order has been preselected, it is possible to retain just a single order (for example the most preselected order), or else that which corresponds to the subframe of the first format which most covers the current subframe of the second format.

Figure 10:
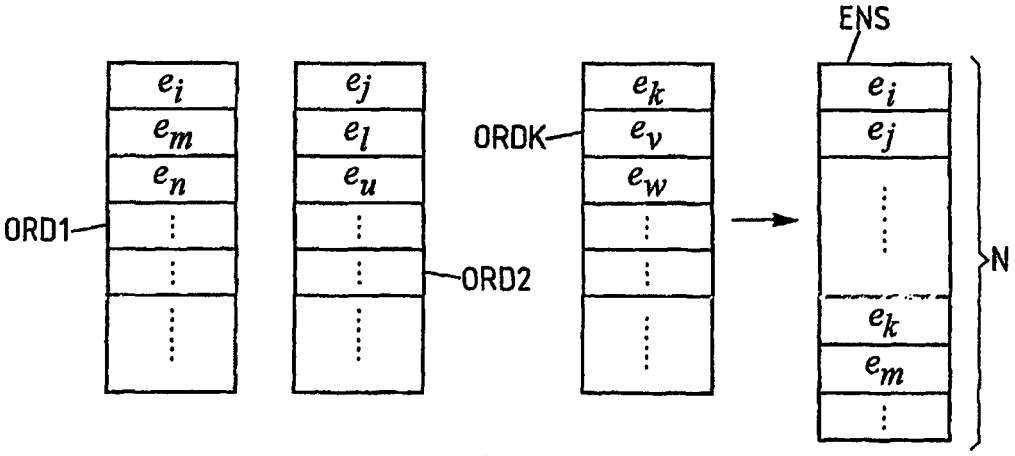

Depending on the type of LTP parameter of the partition of the first dictionary, other criteria may be adopted. Instead of retaining just a single order, another solution consists in combining at least some of the various preselected orders. Several combining procedures are possible. For example, if K orders have been retained, then the first element of each of the K orders is firstly examined, while eliminating any redundancies. $K_1$ elements ($K_1 \leq K$) are obtained. Next, $K_2$ elements are added, such that $K_2 \leq K$ and $K_2 \leq N-K_1$, chosen from the set consisting of the second element of the K orders (while eliminating any redundancies), and so on and so forth until N elements are obtained, N being the maximum number of elements of the second dictionary to be tested. This selection of N elements $e_i, e_j, \ldots, e_k, \ldots$ in the guise of first elements of K orders ORD1, ORD2, . . . , ORDK, has been represented schematically in FIG. 10. The number N of elements retained in the set ENS may be chosen for example as a function of the maximum permitted complexity. In this ranking, it is also possible to favor the elements that are most often ranked among the first ones.

As a variant, it is also possible to construct K subsets of the rankings by preselecting the $N_i(\leq N)$ first elements of each ranking $C_i$ ($1 \leq i \leq K$). The choice of $N_i$ is such that $$\sum Ni \geq N$$

and makes it possible to process the rankings equitably or, conversely, to favor certain rankings. Next, all the elements present in the K subsets and then the elements present in K−1 subsets are selected, and so on and so forth until N elements are retained. If N elements have not been obtained, the number of elements is completed by taking for example successively the following elements in the K subsets.

It is of course possible to combine some of these ranking strategies. It is indicated in a general manner that the second dictionary is preferably explored according to a "dynamic" order thus determined. This procedure for constructing a dynamic order from predetermined, stored orders may also be applied when the classes of the partition are not disjoint and an element of the first dictionary belongs to more than one class.

Described below are three cases of switching from a first LTP model to a second LTP model, illustrating the application of the invention to various models and types of LTP parameters. Of course, although the examples are given only for a first and a second dictionary, the invention is readily generalized to more than one first and/or second dictionary.

Case of Switching from a Monotap Model to a Multitap Model

The parameters of the monotap model of a format COD1 are available and one seeks to determine at least calculational and/or resource cost those of the multitap model of a format COD2. For each subframe, the coder COD1 has determined the pair $(\lambda_e, \beta_e)$ of parameters of the monotap LTP filter. The coding of a subframe of COD2 requires the determination of pairs $(\lambda_s, (\beta_i)_s)$ (where i is a gain index) of parameters of the multitap LTP filter. The suite of parameters of the first model is therefore $(\lambda_e, \beta_e)$. The suite of parameters of the second model is $(\lambda_s, (\beta_i)_s)$.

The determination of the delay $\lambda_s$ is done by one of the known prior art procedures. For example, it is possible to use the intelligent transcoding procedure which determines this delay $\lambda_s$ directly by choosing as delay, that determined by COD1 on its subframe which shares the most samples with the current subframe of COD2 (if this delay $\lambda_e$ is fractional, its integer part or the nearest integer is taken). This situation will be described later with reference to FIGS. 7*a* and 7*b* in particular.

The vector of gains $(\beta_i)_s$ for each subframe of COD2 is then determined, with a low complexity within the meaning of the invention, on the basis of one at least of the gains $\beta_e$ of the subframes of COD1. Through a study which associates the two LTP models, a partition of the first dictionary (here the dictionary of the scalar gains $\beta_e$) has been performed. Orders of the second dictionary which are associated with this partition are then determined. These orders correspond here to the whole set of vectors of gains $(\beta_i)_s$. On the basis of the scalar LTP gains $\beta_e$ chosen by the first format COD1 for its subframes corresponding to a current subframe of COD2, the orders of the second dictionary that are associated with the classes of the scalar gains are preselected. Next, a single of these orders may be retained, or else, an order is constructed dynamically. Finally, the first N vectors of gains determined by this order are tested to select the best vector (according to a criterion such as the usual CELP criterion). It is recalled that, by virtue of the orders, the number N may readily be adjustable as a function for example of the desired quality/complexity compromise. In general, N is much less than the size of the second dictionary.

According to one of the advantages of the present invention, the optimal vector of gains of a multitap LTP filter of a second coding format is thus determined on the basis of at least one gain of a monotap LTP filter of a first format, while considerably reducing the complexity of exploration of the second dictionary of the vectors of gains and while limiting the number of vectors of gains to be tested. Contrary to reference [2] given hereinabove, where, for each monotap gain, a subset of vectors of gains of fixed size is associated, the solution within the meaning of the invention makes it possible to adjust the exploration of the dictionary as a function of the target quality and of the complexity constraints. It will be understood that the invention entails greater involvement of the various orders of the dictionary of vectors of gains than of the predetermined and fixed subsets as in the aforesaid reference.

In the case of an intelligent transcoding from the 8-kbit/s UIT-T G.729 coder to the 6.3-kbit/s UIT-T G.723.1 coder, which will be described later as an exemplary embodiment, the steps set forth hereinabove may be applied to the focusing of the closed-loop search in the two dictionaries of vectors of gains of the G.723.1 on the basis of the LTP gains of the G.729 coder.

Case of Switching from a Multitap Model to a Monotap Model

This particular case is the inverse of the previous one. The parameters of the multitap LTP model of a first format COD1 are available and one seeks to determine at least cost those of the monotap LTP model of a second format COD2. The suite of parameters of the first model is therefore written $(\lambda_e, (\beta_i)_e)$ (where i is a gain index), while the suite of parameters of the second model is written $(\lambda_s, \delta_s)$. On the basis of at least one suite of parameters selected by the first coder COD1, one seeks to obtain a delay $\lambda_s$ and a gain $\beta_s$ for the format COD2. Through a study which associates the two LTP models, a partition of the first dictionary which is, in this case, that of the vectors of gains $(\beta_i)_e$, has been performed. Orders of the second dictionary which are associated with the partition of the first dictionary are then determined, within the meaning of the invention. Here, the second dictionary consists of the whole set of jitter values $(\lambda_e-\lambda_s)$. On the basis of the vectors of gains $(\beta_i)_e$ chosen by the first format COD1, for its subframes which correspond to the current subframe of COD2, the orders of the second dictionary which are associated with the classes of these vectors of gains are preselected. Thereafter, a single of these orders may be retained, or else, an order may be constructed dynamically. Finally, the "neighborhood" values thus determined around one or more anchoring delays $\lambda'_s$ are explored. The determination of the anchoring delay(s) is done by a procedure known in the prior art.

The present invention therefore proposes an original solution which makes it possible to reduce the complexity of determining the delay $\lambda_s$, by reducing the number of delay values tested of a monotap LTP model of a second coding format on the basis of a knowledge of the parameters of a multitap LTP model of a first coding format. Most of the prior art procedures use only the delay without utilizing the gain vector. As in document WO-03058407, here both types of parameters are used. Nevertheless, in contradistinction to the teaching of this last reference, a gain vector points to a set of several jitter values and not to a single value as in this reference. According to one of the advantages afforded by the invention, the problems related to the approximating of a multitap LTP filter by a single monotap filter are thus circumvented.

In an advantageous variant, to limit storage, the ordered neighborhoods are intervals of increasing size. This measure is particularly advantageous for focusing the open-loop and/or closed-loop search. An exemplary embodiment will be described later, relating to the closed-loop search for the LTP delay of the 8-kbit/s UIT-T G.729 coder based on the LTP parameters of the 6.3-kbit/s UIT-T G.723.1 coder.

Case of Switching From a Multitap Model to a Multitap Model

To the knowledge of the inventors, this case has never been studied in the prior art.

The parameters of the multitap model of a first format COD1 are available and one seeks to determine at least cost those of the multitap model of a second format COD2. The suite of parameters of the first model may therefore be written $(\lambda_e, (\lambda_i)_e)$. The suite of parameters of the second model may also be written $(\lambda_s, (\beta_i)_s)$. On the basis of at least one suite of parameters selected by the first format COD1, one seeks to obtain a delay $\lambda_s$ and a vector of gains $(\beta_i)_s$ for the second format COD2.

The determination of the delay $\lambda_s$ on the basis of at least one delay $\lambda_e$ is done by a procedure known in the prior art. It will be supposed that the implementation of the present invention makes it possible here to determine with low complexity the vectors of gains $(\beta_i)_s$ for each subframe of the second format COD2 on the basis of at least one vector of gains $(\beta_i)_e$ of the subframes of the first format COD1. By a study which associates the two multitap LTP models, a partition of the first dictionary which in this case is that of the vectors of gains $(\beta_i)_e$ has been performed, within the meaning of the invention. The orders of the second dictionary (here that of the vectors of gains $(\beta_i)_s$) which are associated with this partition is then determined. On the basis of the vectors of gains $(\beta_i)_e$ chosen by the first format COD1 for its subframes which correspond to the current subframe of the second format COD2, the orders of the second dictionary which are associated with the classes of these vectors of gains are preselected. Thereafter, a single of these orders may be retained, or else an order can be dynamically and progressively constructed. Finally, the first vectors of gains determined by this order are tested to select the best one.

An exemplary embodiment between the bitrates 6.3 kbit/s and 5.3 kbit/s of the UIT-T G.723.1 coder illustrating the latter case is presented later.

EXEMPLARY EMBODIMENTS

Presented hereinbelow are three exemplary embodiments which are aimed at transcoding between two different coding formats UIT-T G.729 and UIT-T G.723.1 in the case of the first two, and a change of bit rate within a multirate coder (UIT-T G.723.1) in the case of the last one. A description of these two UIT-T coders is firstly given together with their LTP modelings.

UIT-T G.729 Coders at 8 kbit/s and UIT-T G.723.1 Coders (6.3 kbit/s and 5.3 kbit/s)

These two coders belong to the family of CELP coders, coders based on analysis by synthesis.

Coders Based on Analysis by Synthesis

In these coders, the synthesis model is used to extract the parameters which model the signals to be coded. These signals may be sampled at the telephone frequency ($F_e$=8 kHz) or a higher frequency, for example at 16 kHz for broadband coding (bandwidth from 50 Hz to 7 kHz). According to the application and the desired quality, the compression factor varies from 1 to 16 so that these coders operate at bit rates of 2 to 16 kbit/s in the telephone band, and at bit rates of 6 to 32 kbit/s in broadband. The digital coding and decoding device of CELP type, the coder based on analysis by synthesis used most widely at present for coding speech signals, is presented in 4*a*. The speech signal $s_0$ is sampled and converted into a string of blocks of (L') samples called frames. In general, each frame is cut up into smaller blocks of (L) samples, called subframes. Each block is synthesized by filtering a waveform extracted from a catalogue (also called the fixed excitation dictionary), multiplied by a gain, through two time-varying filters. The excitation dictionary is a finite set of waveforms of L samples. The first filter is the long-term prediction filter. A "LTP" (Long Term Prediction) analysis makes it possible to evaluate the parameters of this long-term predictor which utilizes the periodicity of the voiced sounds. This predictor is equivalent to a dictionary that stores the past excitation for various delays. This dictionary is generally called the "adaptive excitation dictionary". The second filter is the short-term prediction filter. The "LPC" (Linear Prediction Coding) analysis procedures make it possible to obtain these short-term prediction parameters that are representative of the transfer function of the vocal tract and are characteristic of the spectrum of the signal.

Figure 4A:
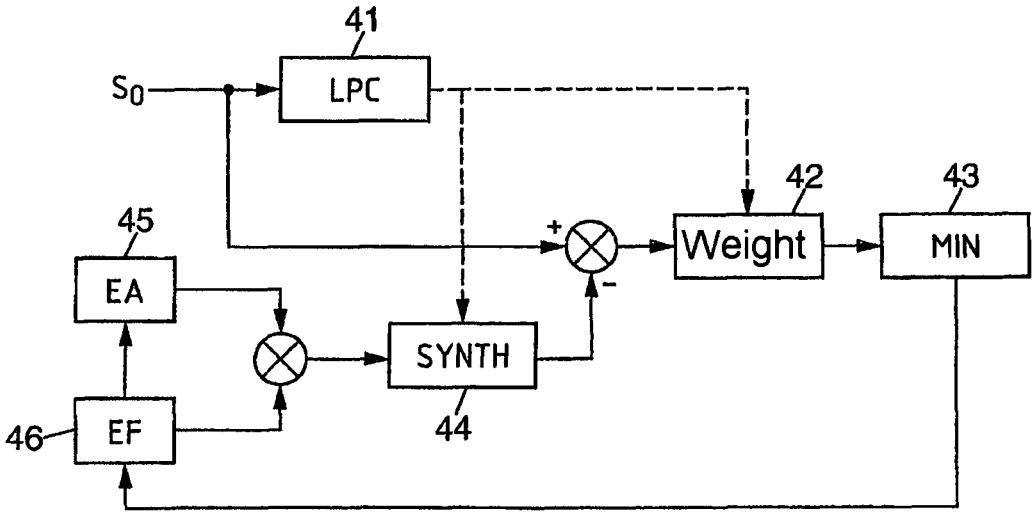

Thus, referring to FIG. 4*a* representing a basic diagram of a CELP coder, the speech signal $s_0$ undergoes the LPC analysis 41 (not represented in detail), as well as an LTP analysis with a construction of the catalogue of fixed excitations 46 and of the adaptive excitations 45 to feed the synthesis filter 44. A perceptual weighting module 42 and an error minimization module 43 are moreover provided in the loop thus constructed.

The method used to determine the innovation sequence is therefore the analysis by synthesis procedure. At the coder, a large number of innovation sequences of the excitation dictionary are filtered by the two LTP and LPC filters, and the waveform selected is that which produces the synthetic signal closest to the original signal according to a perceptual weighting criterion, generally known by the name of the CELP criterion.

LTP Model of the G.729 at 8 kbit/s (Monotap)

Figure 4B:
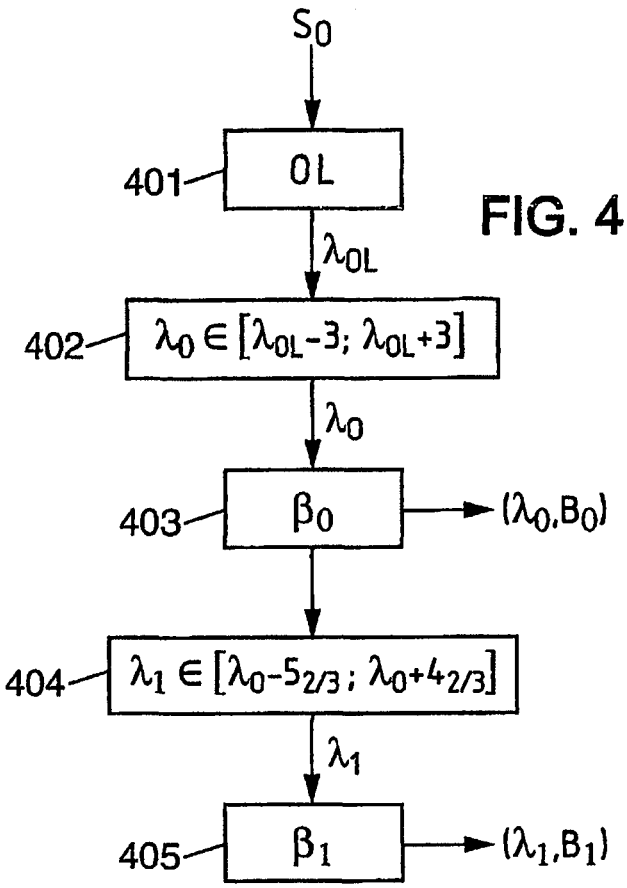

The UIT-T G.729 coder operates on a speech signal limited band-wise to 3.4 kHz, sampled at 8 kHz and cut up into frames of 10 ms (i.e. 80 samples per frame). Each frame is divided into two subframes (numbered 0 and 1 hereinbelow) of 40 samples (5 ms). The LTP model of the UIT-T G.729 coder is based on a monotap modeling with fractional resolution. At each frame, the LTP analysis determines a delay $\lambda_i$ and a gain $\beta_i$ for each subframe. FIG. 4*b* presents the main steps thereof. At each frame, a search for the open-loop delay, denoted $\lambda_{OL}$, is performed in the span of values [20: 143] (step 401). Next, the delay of the first subframe is searched for in a closed loop around the open-loop delay AOL over the span [$\lambda_{OL}$−3; $\lambda_{OL}$+3] (step 402). Therefore, by using synthesis-based analysis, the delay $\lambda_0$ of the even subframe is determined with a fractional resolution of ⅓ in the span [19⅓; 84⅔]

and under integer resolution in the span [85; 143].

Next, the delay $\lambda_1$ of the second subframe is determined with a fractional resolution of ⅓ by analysis by synthesis about $\lambda_0$ over the span [int($\lambda_0$)−$5_{2/3}$; int($\lambda_0$)+$4_{2/3}$], int($\lambda_0$) being the integer part of the possibly fractional delay $\lambda_0$ (step 404). For each subframe, the gain β is calculated once the closed-loop delay has been determined (steps 403 and 405). After the search for the fixed excitation, the gain β is quantized jointly with the gain of the fixed excitation by vector quantization on 7 bits. The definition set (or dictionary) of monotap LTP gain of the G.729 therefore has a size of 128.

LTP Model of the G.723.1 (Multitap)

The UIT-T G.723.1 coder operates on a speech signal limited band-wise to 3.4 kHz, sampled at 8 kHz and cut up into frames of 30 ms (i.e. 240 samples per frame). Each frame comprises 4 subframes of 7.5 ms (60 samples) grouped 2 by 2 into super subframes of 15 ms (120 samples). The UIT-T G723.1 coder uses a multitap modeling of order 5. The coefficients of the long-term predictor are quantized vectorally by means of two dictionaries previously stored with 85 or 170 entries for the 6.3-kbit/s mode, while the 5.3-kbit/s mode uses only the dictionary with 170 entries. In the 6.3-kbit/s mode, the choice of the dictionary explored depends on the delay value of the even subframes.

Figure 4C:
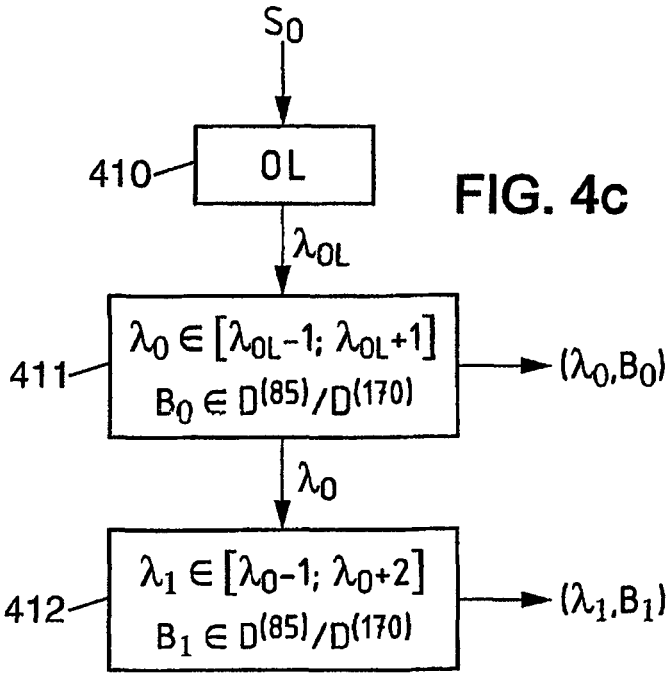

FIG. 4*c* illustrates the main steps of the LTP analysis of the G.723.1 coder. At each frame, two open-loop LTP analyses (once per super subframe) are performed to estimate a delay $\lambda^i_{OL}$ (i=0 or 1) over the span [18; 142] for each block of 120 samples (step 410). Next, for each super subframe, two closed-loop LTP analyses (one for each subframe) are performed. The delays $\lambda_{2i}$ of the even subframes (subframes 0 and 2) are searched for in closed loop about the corresponding delay $\lambda^i_{OL}$ over the span [$\lambda^i_{OL}$−1; $\lambda^i_{OL}$+1]. Jointly with this search, the dictionary of gain vectors is also explored by analysis by synthesis (step 411). For the odd subframes (subframes 1 and 3), a similar search (joint search for the gain vector and for the delay in closed loop) is performed and the search for a delay $\lambda_{2i+1}$ in closed loop is limited to the neighborhood of the closed-loop delay of the previous subframe [$\lambda_{2i}$−1; $\lambda_{2i}$+2] (step 412).

First Exemplary Embodiment

Determination of the Multitap LTP Parameters of the 6.3-Kbit/s G.723.1 on the Basis of the Monotap LTP Parameters of the 8-Kbit/s G.729

As presented in FIG. 5*a*, by conventionally taking a common time origin, a G.723.1 coding frame corresponds to three G.729 coding frames. It is therefore apparent that the subframes of the G.729 do not coincide with those of the G.723.1, but on the contrary the latter (7.5 ms) overlap the former (5 ms). FIG. 5*b* represents a frame of the G.723.1 coding and three G.729 coding frames and their respective subframes. The subframes of the frame of the G.723.1 are numbered from 0 to 3. The three frames of the G.729 are grouped together and their subframes are numbered from 0 to 5.

Determination of the Delay of the Multitap Filter

The determination of the delay is direct. Thus, for the even subframes of the G.723.1, that is to say subframes 0 and 2, the delay is taken equal to the integer part of that of the subframes 1 and 4 of the G.729. For the odd subframes, a closed loop is performed about the previous delay (even subframe). This closed loop may be identical to that of the G.723.1, but may also be restricted according to the desired complexity, or even eliminated so as to keep the same delay value on the two subframes, even and odd.

Determination of the Coefficients of the Multitap Filter

Here, only a single first dictionary is considered, namely the set of the 128 monotap LTP gains of the G.729, whereas two possible second dictionaries are considered (the two dictionaries of vectors of gains of the G.723.1, the choice of which depends on the delay of the subframes).

Once the delay has been determined, it still remains to determine a vector of 5 gains in the dictionary of vectors of 5 coefficients that the G.723.1 coder selects. The implementation of the present invention makes it possible to restrict the exploration thereof to a limited number of vectors of gains determined on the basis of the monotap LTP gains of the subframes of the G.729 coder.

A statistical study has been carried out beforehand by associating within one and the same coder the multitap model of the G.723.1 coder and the monotap model of the G.729 coder. This study has made it possible to rank the 170 and 85 vectors of multitap LTP gains of the two dictionaries of the G.723.1 according to their impact on the quality of the signal retrieved, for each of the 128 monotap LTP gains of the G.729. Here, it is the CELP criterion which is used for this purpose. For each of these two dictionaries of the G.723.1, 128 orders (or rankings) associated with the elementary partition of the set of 128 monotap LTP gains have thus been obtained.

Each subframe of the G.723.1 covers (at least partially) two subframes of the G.729. Firstly, the two monotap gains (denoted $g_1$ and $g_2$) of these two corresponding subframes of the G.729 are extracted. With each of these two gains is associated a ranking $C(g_i)$ of the vectors of the dictionary of vectors of multitap coefficients. This dictionary is selected by the value of the delay of the even subframe of the G.723.1.

Let N be the maximum permitted number of vectors of multitap gains for the current subframe of the G.723.1 coder. If the two gains of the G.729 are equal, there is therefore just one ranking and the first N elements ordered by this ranking of the dictionary of vectors of gains are retained. Otherwise, an order of N elements is constructed from two different orders. For example, two subsets of the rankings $C(g_1)$ and $C(g_2)$ are constructed by preselecting their first $N_1$ and $N_2$ (respectively) elements. $N_1$ and $N_2$ are less than or equal to N. The two rankings ($N_1=N_2$) can be processed equitably or one of the two rankings can be favored. For example, it is possible to favor the ranking associated with the largest monotap gain (typically if $g_1>g_2$ then $0\leq N_2\leq N_1\leq N$). Is also possible to favor the one whose G.729 subframe most overlaps the G.723.1 subframe considered. Next, all the elements belonging to the two subsets are firstly selected. The set forming the dictionary is supplemented to N, by taking alternately in the two subsets the element ranked best among the remaining ones. Here again, it is possible, by supplementing, to give preference to one of their two subsets. It is of course possible to combine some of these strategies. For example, choose $N_1=N_2$ but after selecting the common elements, continue with the remaining elements of one of the two rankings before possibly supplementing with the remaining elements of the other rankings. The strategy may also vary depending on the G.723.1 subframe considered.

Figure 9A:
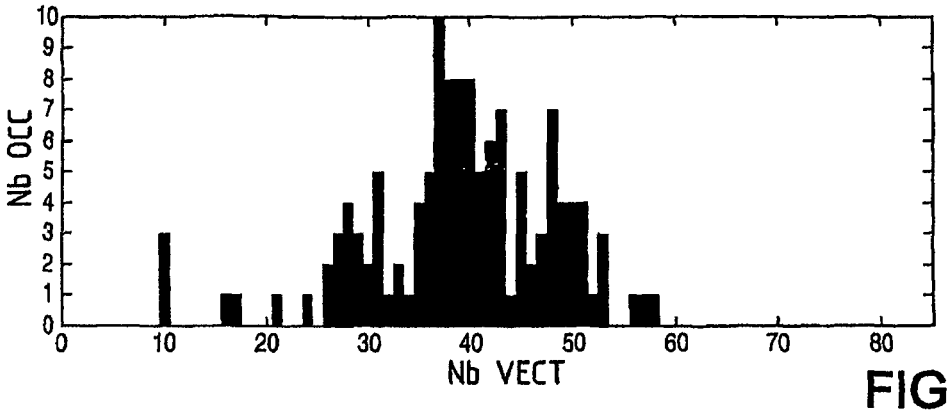
FIGS. 9*a* and 9*b* represent histograms of reduced sizes of exploration (number of occurrences along the ordinate) in dictionaries (initially of 85 vectors for FIG. 9*a* and of 170 vectors for FIG. 9*b*), and guaranteeing less than 1% reduction in quality according to the CELP criterion, and FIG. 10 schematically represents the selection of N elements of the second dictionary when several orders are constructed, in a particular embodiment.
Figure 9B:
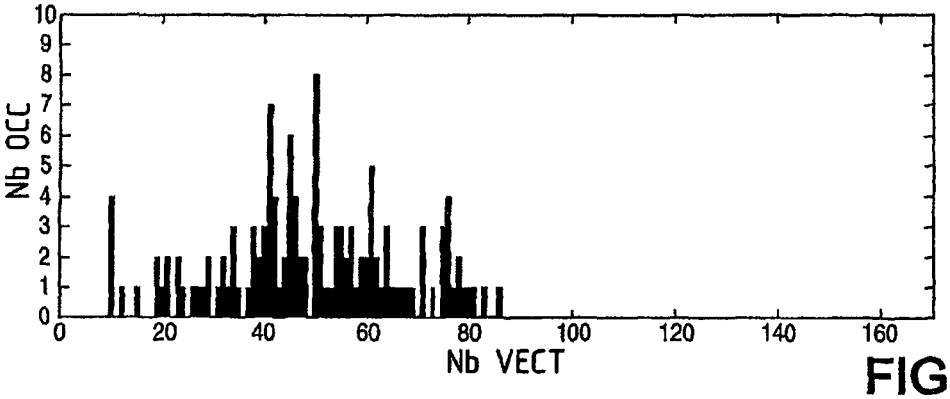

Finally, the exploration of the dictionary of vectors of gains is limited to the N vectors determined by virtue of the "dynamic" order thus constructed. This focused exploration makes it possible to select the best gain vector. Preferably, the selection criterion is the CELP criterion used conventionally by the G.723.1 for exploring the dictionaries of vectors with 5 LTP coefficients. The solution set forth here allows a very great reduction in the complexity of the LTP analysis of the G.723.1 coding without, however, impairing the quality. By way of example of performance, FIGS. 9*a* and 9*b* represent, for the two dictionaries, the histogram of the exploration sizes which guarantee a loss in the CELP criterion of strictly less than 1% with respect to complete exploration. It should be noted that the exploration sizes (along the abscissa) are much smaller than the total size of the dictionary. Thus, the average size is 39 for the dictionary with 85 vectors and 49 for the dictionary with 170 vectors. On the learning base used, the statistical study shows, even for average exploration sizes, much smaller than the sizes of the dictionaries (48 instead of 85 and 58 instead of 170), that the restricted exploration is optimal according to the CELP criterion (practically no loss in the CELP criterion). Focused searching can therefore lead to performance which is equivalent to exhaustive searching while exploring scarcely more than half the dictionary of size 85 and a third of the dictionary of size 170. These numbers clearly illustrate the reduction in complexity afforded by implementing the present invention.

Additionally, complete storage of the 128 orders for the two dictionaries represents a total of 128*(170+85)=32640 index values to be stored. In reality, it is not necessary to retain all these values since, as indicated hereinabove, only a limited number is necessary. Thus, for a zero loss in the CELP criterion, trials show that it would be sufficient to store about 13582 indices. By choosing a weaker constraint on the CELP criterion, this number can be reduced again (down to 11251 values for 1% loss). It can be greatly reduced again by adopting a partition other than the elementary partition for the set of monotap gains.

Second Exemplary Embodiment

Determination of the Monotap LTP Parameters of the 8-kbit/s G.729 on the Basis of the Multitap LTP Parameters of the 6.3-kbit/s G.723.1

In contradistinction to the previous exemplary embodiment, the parameters of the multitap LTP model of a G.723.1 frame are available and one seeks to obtain the monotap LTP parameters of the G.729 for three frames, that is to say six subframes (see FIG. 5*b*).

Determination of the Open-Loop Delay

The open-loop search has been eliminated. To do this, each of the three G.729 frames firstly adopts the delay of one of the subframes of the G.723.1 coder as open-loop delay. The correspondence between G.729 frames and G.723.1 subframes is illustrated in FIG. 6.

However, it should be noted that the delay chosen by the G.723.1 coder may be outside the span of values permitted by the G.729 coder. Specifically, the smallest value permitted by the G.729 coder is 19 whereas it is 18 for the G.723.1 coder. Several solutions are possible for getting round this problem. Typically, it is for example possible to double the delay arising from the G.723.1 coder, or more simply add 1 to it.

Determination of the Closed-Loop Delay

Once the open-loop delays have been fixed for the three frames of the G.729 coder, it remains to perform, for each subframe, the closed-loop search. It is recalled that the spans of values are as follows:

$$\lambda_0 \in [\lambda_{OL} - 3; \lambda_{OL} + 3] \text{ and } \lambda_1 \in \left[\text{int}\left(\lambda_0 - 5\frac{2}{3}\right); \text{int}\left(\lambda_0 + 4\frac{2}{3}\right)\right]$$

The basic closed-loop search for the G.729 coder consists firstly in successively testing all the integer values of the span (7 values for $\lambda_0$ and 10 for $\lambda_1$). Once the best integer value has been selected, the various fractions (−⅔, −⅓, ⅓, ⅔) are tested to determine the best one according to the criterion chosen, in this instance the one which maximizes the CELP criterion. For the even subframe, it will be noted that the fractional part is searched for only if the integer part of $\lambda_0$ is less than 85.

Here, the first dictionary (in the definition of the invention given hereinabove) is one of the two dictionaries of LTP gain vectors of the G.723.1 coder, the second dictionary being one of the two sets of neighborhood integer values (or jitter) around an anchoring delay. It will then be understood that the invention may be applied readily to more than one first dictionary, on the one hand, and to more than one second dictionary, on the other hand.

To reduce the complexity of the closed-loop search for the integer values within the neighborhood of the anchoring value $\lambda'(\lambda_{OL}$ or $\text{int}(\lambda_0))$, it is proposed, within the meaning of the invention, that the number of integer delay values tested by the closed loops be limited. Depending on the choice of LTP gain vector made by the G.723.1, only a reduced number of values is tested. The integer delay is determined in this restricted set. Next, the fractional part is searched for in a conventional manner.

A statistical study has been carried out beforehand by associating within one and the same coder the multitap model of the G.723.1 and the monotap model of the G.729. This study has made it possible to establish for the two closed-loop search neighborhoods of the G.729 (even and odd subframes) an order of importance of the neighborhood values according to their impact on the quality of the signal retrieved, for each of the gain vectors of the two multitap LTP dictionaries of the G.723.1. This classification makes it possible to choose the number of values tested according to the quality and complexity constraints and to limit, for each of the six subframes of the G.729, the extent of the closed loop based on the choice of the gains $\beta_i$ made for the subframes of the G.723.1. By using the correspondence between subframes of the table of FIG. 8, each G.729 subframe is associated with one or two G.723.1 subframes. Based on the vector of 5 coefficients of the gain vector $(\beta_i)$, the neighborhood values of $\lambda'$ are ranked in order of decreasing importance. The number of values tested is then determined as a function of the target complexity or of the target quality/complexity ratio.

The association between even (respectively odd) subframes of the G.729 coder and the suite of parameters $(\lambda_j, (\beta_i)_j)$, arising from the G.723.1 coder is illustrated in FIG. 7*a* (respectively in FIG. 7*b*).

It will be noted that for certain subframes, the anchoring value $\lambda'$ may be different from the delay $\lambda_j$ of the parameter suite $(\lambda_j, (\beta_i)_j)$ determined for the associated G.723.1 subframe. This point is explained later where the parity of the subframes (even or odd) is taken into account. In a first variant, it is simply possible to ignore any difference. Advantageously, in another variant, the set of ordered neighborhoods is modified as a function of the difference $(\lambda_j-\lambda')$ and the size of this set may possibly be modified. Preferably, the difference $(\lambda_j-\lambda')$ is subtracted from each element of this neighborhood ordered according to the gains $(\beta_i)_j$ and consideration is given to its intersection with the set defining the neighborhoods (here the interval [−3;3] for the even subframes and the interval [−5;4] for the odd subframes, as will be seen later).

It is also possible to condition the use of the restricted neighborhoods as a function of the deviation between the two delays. The strategy may therefore be adapted to the subframe or to the deviation between the delays, or to the two criteria combined.

Even Subframes

The search must be performed around the open-loop delay $\lambda_{0L}$ over the span $[\lambda_{0L}-3; \lambda_{OL}+3]$. Depending on the vector(s) of gains chosen by the G.723.1 coder, orders of the set of 7 jitter values (−3, −2, −1, 0, 1, 2, 3) are determined. For subframe 0 (respectively 2) of the G.729 coder, there is only a single associated subframe of the G.723.1 and hence a single vector of gains and, thus, a single order. On the other hand, two subframes of the G.723.1 coder are associated with subframe 4 of the G.729 coder, as shown by FIG. 7*a*. Two orders of the set of neighborhoods are therefore preselected by the gain vectors $(\beta_i)_2$ and $(\beta_i)_3$. As indicated hereinabove, a single order can be adopted or the two orders can be combined. If only the order associated with the vector $(\beta_i)_3$ is adopted, or if $\lambda_2=\lambda_3$ is fixed (where $\lambda_3$ is the anchoring value), no particular processing is performed. Otherwise, the ordered set of 7 neighborhoods corresponding to $(\beta_i)_2$ is modified as a function of $\lambda_2-\lambda_3$). Next, the set ordered according to $(\beta_i)_3$ may possibly be used for completing. The first N elements according to the order obtained are tested, the size N (N≤7) is defined as a function of the complexity or quality/complexity compromise targeted.

Odd Subframes

The search must be conducted around the integer part $\lambda'_{2p}$ of the previous (even) subframe over the span $[\lambda'_{2p}-5_{2/3}; \lambda'_{2p}+4_{2/3}]$. For these odd subframes, just as for the even subframe 4, the delay $\lambda_j$ of the parameter suite $(\lambda_j, (\lambda_i)_j)$ of the associated G.723.1 subframe(s) may be different from this anchoring value $\lambda'_{2p}$. Depending on the vector(s) $(\beta_i)_j$ of gains chosen by the G.723.1 coder, orders of the set of 10 jitter values are preselected and modified as a function of the difference $(\lambda_j-\lambda'_{2p})$. Let N(N≤10) be the maximum permitted number of tested values.

To determine the restricted search span, the following procedure is preferably carried out for each odd subframe.

Subframe 1:

The total search span is $[\lambda'_0-5_{2/3}; \lambda'_0+4_{2/3}]$. Two orders corresponding to the gain vectors $(\beta_i)_0$ and $(\beta_i)_1$ are preselected. Next, the ordered neighborhoods are modified as a function of the differences $(\lambda_0-\lambda'_0)$ and $(\lambda_1-\lambda'_0)$. These two deviations are limited since:

- on the one hand, the closed-loop delay $\lambda'_0$ of the G.729 is in the neighborhood (in the interval [−3;3] of the open-loop delay (here, taken equal to $\lambda_0$ corresponding to the closed-loop delay of the G.723.1),
- on the other hand, in the G.723.1 coder, the deviation between the closed-loop delays of an even subframe and the following odd subframe is limited since the difference $(\lambda_1-\lambda_0)$ is in the interval [−1,2].

On the basis of the first $N_1$ and $N_2$ elements of the modified neighborhoods, a single ordered neighborhood of size N is constructed. The values that are common to both subsets are firstly selected, then the set is completed, if necessary, by alternately taking the best remaining value in the two subsets. The closed-loop search is then conducted in the subset thus constructed.

Subframe 3:

The total search span is $[\lambda'_2-5_{2/3}; \lambda_2+4_{2/3}]$. An order corresponding to the gain vector $(\beta_i)_2$ is selected. Next, the ordered neighborhood is modified as a function of the difference ($\lambda_2-\lambda'_2$). In contradistinction to the previous case, the deviation between $\lambda_2$ and $\lambda'_2$ may be sizeable in the intersection of the ordered neighborhood, modified by subtracting ($\lambda_2-\lambda_2$), may be zero. In this case, preferably, the search is done over the whole span [$\lambda'_1-5_{2/3}$; $\lambda'_1+4_{2/3}$]. The use of ordered neighborhoods may also be conditioned to a threshold on $|\lambda_2-\lambda'_2|$. For example, the neighborhoods are restricted only if $|\lambda_2-\lambda'_2|3$; otherwise, the whole span [−5,4] is explored. The choice of this variant may also depend on the permitted complexity.

Subframe 5:

The total search span is [$\lambda'_4-5_{2/3}$; $\lambda'_4+4_{2/3}$]. An order corresponding to the gain vector $(\beta_i)_3$ is selected. Next, the ordered neighborhood is modified as a function of the difference ($\lambda_3-\lambda'_4$). As in the case of subframe 1, this deviation is limited. Specifically, the closed-loop delay of the G.729, $\lambda'_2$, is in the neighborhood ([−3,3]) of the open-loop delay (here taken equal to the closed-loop delay $\lambda_3$ of the G.723.1). The first N values of the modified ordered set are explored.

The solution presented here allows a very great reduction in the complexity of the LTP analysis of the G.729 coding. Relative to exploring the complete neighborhoods, the invention makes it possible to test only 60% (respectively 40%) of the neighborhood values if the gain vector of the G.723.1 coder is in the dictionary with 170 entries (respectively 85 entries).

Third Exemplary Embodiment

Determination of the Multitap LTP Parameters of the 5.3-kbit/s G.723.1 Coder on the Basis of the Multitap LTP Parameters of the 6.3-kbit/s G.723.1 Coder The two models are much the same and differ practically only by the choice of the dictionary of multitap LTP gain vectors.

Determination of the Delay of the Multitap Filter

In a similar manner to the determination of the delay of a monotap described hereinabove on the basis of the multitap LTP parameters, it is possible to use the delay of the even subframes, as open-loop delay of the super subframe, then to restrict the span of variation of the closed-loop delay of the 5.3-kbit/s mode as a function of the vector of five coefficients of the filter chosen by the 6.3-kbit/s mode. Preferably, no processing other than a simple copying of the delay is necessary. Thus, each subframe of the 5.3-kbit/s adopts the delay that the 6.3-kbit/s mode has chosen for the same subframe, as delay.

Determination of the Coefficients of the Multitap Filter

Here, there is a single second dictionary which is the dictionary with 170 vectors of five coefficients of the 5.3-kbit/s mode whereas it is necessary to consider two "first dictionaries", according to the terminology used in the general definition of the invention. These two first dictionaries are the two dictionaries of vectors of gains used by the 6.3-kbit/s mode of the G.723.1.

In this exemplary embodiment, one therefore seeks to determine for the 5.3-kbit/s mode a gain vector in the dictionary with 170 entries on the basis of a gain vector selected by the 6.3-kbit/s mode in one of the two dictionaries (with 170 or 85 vectors).

One of the two cases may seem trivial since if the 6.3-kbit/s mode uses the same dictionary (the dictionary with 170 vectors) for the current subframe, it would be tempting to choose the same vector as the 6.3-kbit/s mode for the 5.3-kbit/s mode. Nevertheless, this approach introduces a noticeable degradation of the signal. Specifically, although the LTP modeling is identical for both modes (same dictionaries of delays and of vectors of 5 gains), it should be borne in mind that the remainder of the coding process is not the same. The LTP filtering is therefore not applied to the same signal and it is thus necessary to widen the choice of vectors of coefficients of the filter for the 5.3-kbit/s mode.

For this purpose, a study has been carried out on the two dictionaries to associate with each of the vectors, a ranking of the vectors of the dictionary with 170 vectors.

Thus, to select a gain vector for the 5.3-kbit/s mode, it is preferred, on the basis of the choice of the gain vector made by the 6.3-kbit/s mode, to explore in the large dictionary (170 vectors) only a set restricted to the first N vectors of the ranking associated with the gain vector chosen by the 6.3-kbit/s mode. The size N depends on the complexity or the quality or the quality complexity compromise desired. Thus, as described hereinabove, the gain vector which maximizes a criterion, preferably the CELP criterion, is selected from this subset.

The invention claimed is:

1. A method of coding according to a second coding format, on the basis of information obtained by implementing at least one step of coding according to a first coding format, the first and second coding formats implementing, in particular for the coding of a speech signal, a step of searching for long-term prediction (LTP) parameters by exploring at least one dictionary having candidate parameters, one at least of the first and second coding formats using a multitap filtering with several coefficients for a fine search for the LTP parameters, the method comprising:

a) conducting one of a statistical and analytical study, as a function of successive suites of LTP parameters according to the first coding format, so as to determine a number of orders and appropriate orders in a dictionary that the second coding format uses;

b) recovering a priori information including information corresponding to a partition of the first dictionary relating to a class of the partition to which an LTP parameter obtained in the course of the coding according to the first coding format belongs, so as to select at least one order from said dictionary that the second coding format uses;

c) applying the selected order to the candidate parameters of said dictionary that the second coding format uses so as to rank the candidate parameters;

d) choose the m first ranked candidate parameters as a plurality of first candidate parameters, m depending on a desired quality or complexity; and e) performing the second coding by conducting the fine search for the LTP parameters only among said plurality of candidate parameters, wherein the first coding format uses a first dictionary and the second coding format uses a second dictionary, and wherein a plurality of similar orders is grouped so as to dynamically modify an initial partition of the first dictionary and, thereby, a number of orders of the second dictionary.

2. The method as claimed in claim 1, wherein the first dictionary has N elements, and wherein the N elements are partitioned into N disjoint classes of size 1.

3. The method as claimed in claim 1, wherein the first dictionary is partitioned into non-disjoint classes, so that one element can be associated with more than one order of the second dictionary.

4. The method as claimed in claim 1, further including successively recalculating the orders of the second dictionary, once grouped together, and dynamically modifying the initial partition of one of the first dictionary and the orders thus grouped together.

5. The method as claimed in claim 1, wherein for each of the orders of the second dictionary, a maximum number of elements of the second dictionary to be retained is chosen as a function of one of the classes of the first dictionary and the orders of the second dictionary, so as to limit a memory resource used for storing the orders of the second dictionary.

6. The method as claimed in claim 1, wherein said plurality of candidate parameters is chosen as a function of a compromise between quality and complexity of the second coding.

7. The method as claimed in claim 6, wherein an input signal to be coded is processed by data blocks, and said compromise is fixed dynamically, with each data block to be processed as a function of one of parameters of the first coding format and characteristics of the signal to be coded.

8. The method as claimed in claim 7, wherein said compromise is fixed dynamically as a function of LTP subframes corresponding to each data block.

9. The method as claimed in claim 1, wherein an input signal to be coded is processed by data blocks each comprising, for the first coding format, first LTP subframes and, for the second coding format, second LTP subframes; and wherein, for first and second subframes of identical duration, to each current subframe of the second coding format there corresponds a single subframe of the first coding format; and:

the first coding format selects a first suite of LTP parameters for the current subframe;

on the basis of the partition by classes of the first dictionary associated with one of the LTP parameters of the first format, selecting an order of exploration of the second dictionary of the second format by choosing an order associated with the class of the element of said first suite; and following the order thus selected, exploring a limited number of first candidate parameters of the second dictionary of the second format.

10. The method as claimed in claim 1, wherein an input signal to be coded is processed by data blocks each having, for the first coding format, first LTP subframes and, for the second coding format, second LTP subframes, and wherein, for first and second subframes of different durations:

the first coding format selects a plurality of LTP parameter suites, for first subframes corresponding substantially to a second current subframe;

on the basis of the partition by classes of the first dictionary associated with one of the LTP parameters of the first format, orders of exploration of the second dictionary of the second format are preselected by choosing the orders associated with the classes of the elements of said LTP parameter suites;

at least one preferred order is determined on the basis of the preselection of said orders; and said second dictionary of the second format is explored following the preferred order, limiting the exploration to its first elements.

11. The method as claimed in claim 10, wherein the preferred order is that which is most preselected from among the preselected orders for a second current subframe.

12. The method as claimed in claim 10, wherein the preferred order is that which corresponds to the subframe of the first format which most covers a current subframe of the second format.

13. The method as claimed in claim 10, wherein a combination of a plurality of orders of the second dictionary of the second format is retained according to the following steps, so as to obtain a dynamic order of N elements of the second dictionary of the second format, comprising:

preselecting K orders;

examining the first element of each of the K orders while eliminating any redundancies, to obtain $K_1$ elements, with $K_1 \leq K$;

adding $K_2$ elements chosen from a set including the second element of the K orders while eliminating any redundancies, and such that $K_2 \leq K$ and $K_2 \leq N-K_1$, and substantially these steps are repeated until said N elements are obtained.

14. The method as claimed in claim 10, wherein a combination of a plurality of orders of the second dictionary of the second format is retained, according to the following steps, so as to obtain a dynamic order of N elements of the second dictionary of the second format, the steps comprising:

constructing K subsets of rankings by preselecting the first $N_i$ elements, with $N_i \leq N$, of each ranking $C_i$, with i lying between 1 and K;

choosing the $N_i$ elements so that $\Sigma Ni \geq N$;

selecting all the elements present in the K subsets; and repeating the selecting step with a selection of the elements present in K-i subsets, where i increases by recurrence until N elements are retained.

15. The method as claimed in claim 1, wherein the first coding format uses a filtering with one coefficient for first LTP subframes while the second coding format uses a filtering with several coefficients for second LTP subframes, further comprising:

determining for each first subframe, by implementing the first coding format, a pair $(\lambda_e, \beta_e)$ of first parameters of the LTP filter with one coefficient;

determining, for the coding of a second current subframe, a plurality of pairs $(\lambda_s,(\beta_i)_s)$ of parameters of the LTP filter with several coefficients on the basis of the suite of parameters of the first format $(\lambda_e,\beta_e)$, with:

a determination of an LTP delay $\lambda_s$ corresponding preferably to that determined by the first coding format on a first subframe which most overlaps the second current subframe; and a determination of a vector of gains $(\beta_i)_s$ for the second current subframe on the basis of one at least of the gains $\beta_e$ of the first subframes, by implementing steps (b), (c) and (d) where the orders of the second dictionary of the second format correspond to a set of gain vectors $(\beta_i)_s$ of the second subframe.

16. The method as claimed in claim 15, wherein for the coding of a second current subframe, the method further comprises:

preselecting, on the basis of first LTP gains of the first format $\beta_e$ that are chosen for one or more first subframes corresponding to a second current subframe, the orders of the second dictionary of the second format, that are associated with classes of the first LTP gains;

constructing a single one of these orders, on the basis of said orders preselected for said second current subframe; and testing N first vectors of seconds gains, determined by the order constructed, so as to select, according to a chosen criterion, a better vector of gains to be associated with the second subframe.

17. The method as claimed in claim 1, wherein the second coding format uses a filtering with one coefficient for second LTP subframes while the first coding format uses a filtering with several coefficients for first LTP subframes, the method further comprising:

determining for each first subframe, by implementing the first coding format, a first suite of LTP parameters $\lambda_e$, $(\beta_i)_e$ corresponding to a pair comprising an LTP delay $\lambda_e$ and a vector of associated gains $(\beta_i)_e$ of the LTP filter with several coefficients;

performing a partition of a said first dictionary of the gain vectors $(\beta_i)_e$ of the first format;

determining for the coding of a second current subframe by the second format, orders of a second dictionary of the second format for first subframes corresponding to the second current subframe, said second dictionary of the second format being constructed from a set of jitter values and said orders of this second dictionary being associated with the partition of the first dictionary of the first format; and determining an order of the jitter values and LTP delay values for the second format are explored successively on the jitter values thus ordered and at least one anchoring delays determined as a function of the delays $\lambda_e$ on the first subframes.

18. The method as claimed in claim 17, wherein various LTP delay values are tested according to a chosen criterion.

19. The method as claimed in claim 17, wherein said jitter values thus ordered are of amplitudes that increase in size as a function of the exploration.

20. The method as claimed in claim 1, wherein the first coding format uses a filtering with several coefficients on first LTP subframes and the second coding format uses a filtering with several coefficients on second LTP subframes, and wherein:

on the basis of at least one first suite of parameters selected by the first format and including at least one vector of gains $(\beta_i)_e$ determined for at least one first subframe, a partition is conducted of the first dictionary of the first format corresponding to a dictionary of the gain vectors of the first format $(\beta_i)_e$;

orders of the second dictionary of the second format corresponding to a dictionary of the gain vectors $(\beta_i)_s$ of the second format are deduced therefrom, said orders being associated with said partition;

on the basis of gain vectors $(\beta_i)_e$ chosen by the first format for first subframes which substantially cover the second current subframe, orders of the second dictionary that are associated with classes of said partition are preselected;

one of the preselected orders is retained;

several gain vectors to be associated with the second current subframe are determined as a function of the order retained; and by tests on said several gain vectors, the best gain vector is selected according to a chosen criterion.

21. The method as claimed in one of claims 16, 18 and 20, wherein the chosen criterion is the CELP criterion.

22. A device for coding according to a second coding format, designed to use coding information obtained by implementing a coding according to a first coding format, the first and second coding formats implementing, in particular for the coding of a speech signal, a search for long-term prediction (LTP) parameters by exploring a dictionary comprising candidate parameters, one at least of the first and second coding formats using a multitap filtering with several coefficients for a fine search for the LTP parameters, the device comprising:

a memory storing a correspondence table defining, as a function of LTP parameters determined by the first coding format which uses a first dictionary, orders of a second dictionary that the second coding format uses, an order being defined by ranking elements of said second dictionary according to a certain criterion, said correspondence table being defined by conducting one of a statistical and analytical study, as a function of successive suites of LTP parameters according to the first coding format, so as to determine a number of orders and appropriate orders in a said second dictionary that the second coding format uses, wherein a plurality of similar orders is grouped so as to dynamically modify an initial partition of the first dictionary and, thereby, a number of orders of the second dictionary;

a component configured to recover a signal giving at least one a priori information including information corresponding to a partition of the first dictionary relating to a class of the partition to which an LTP parameter obtained in the course of the coding according to the first coding format belongs on LTP parameters in the course of a coding according to the first coding format;

a component configured to be active on reception of said signal for consulting said correspondence table and selecting at least one order of said second dictionary of the second coding format; and a calculator which:

ranks the candidate parameters of said second dictionary of the second coding format according to the selected order, with a view to choosing the m first ranked candidate parameters as a plurality of first candidate parameters from the second dictionary, m depending on a desired quality or complexity; and continues the coding according to the second coding format, by conducting the LTP search only among the plurality of first candidate parameters.

23. A coding system implementing at least one first and one second coding format, comprising at least one device for coding according to the first format and a coding device as claimed in claim 22, applying said second format.

24. The coding system as claimed in claim 23, wherein the device for coding according to the first format and the device for coding according to the second format are placed in cascade, for a transcoding.

25. The coding system as claimed in claim 23, wherein the device for coding according to the first format and the device for coding according to the second format are placed in parallel, for a multiple coding.

26. A computer program product, stored in a memory of a processing unit or on a non-transitory removable medium intended to cooperate with a reader of said processing unit, comprising instructions for implementing the steps of the method as claimed in any one of claim 2, 3, 4, 8, or 9-20.

* * * * *

UNITED STATES PATENT AND TRADEMARK OFFICE

CERTIFICATE OF CORRECTION

PATENT NO. : 8,670,982 B2
APPLICATION NO. : 11/795085
DATED : March 11, 2014
INVENTOR(S) : Ghenania et al.

It is certified that error appears in the above-identified patent and that said Letters Patent is hereby corrected as shown below:

On the Title Page

In column 2 (page 2, item 56) at line 21, Under Other Publications, change "Processign," to --Processing,--.

In the Specification

In column 1 at line 66, Change "hinter (iD-1)," to --$h_{inter}$ (iD-1),--.

In column 1 at line 66, Change "hinter" to --$h_{inter}$--.

In column 7 at lines 19-20, Change

"85 vectors for

FIG. 9a and" to --85 vectors for FIG. 9a and--.

In column 8 at line 42, Change "$e_i^2$, $e_j^2$, $e_k^2$" to --$e_i^2$, $e_j^2$, $e_k^2$,...--.

In column 14 at line 28, Change "$(\lambda_e, (\lambda_i)_e)$" to --$(\lambda_e, (\beta_i)_e)$--.

In column 15 at line 66, Change "AOL" to --$\lambda_{OL}$--.

In column 20 at line 35, Change "$(\lambda_j, (\lambda_i)_j)$" to --$(\lambda_j, (\beta_i)_j)$--.

In column 21 at line 9, Change "$|\lambda_2 - \lambda'_2|$ 3" to --$|\lambda_2 - \lambda'_2| < 3$--.

Signed and Sealed this
Second Day of September, 2014

Michelle K. Lee

Michelle K. Lee
*Deputy Director of the United States Patent and Trademark Office*